US009080793B2

(12) United States Patent
Tatarinov et al.

(10) Patent No.: US 9,080,793 B2
(45) Date of Patent: Jul. 14, 2015

(54) METHOD AND APPARATUS IN CONNECTION WITH A VORTEX TUBE PROCESS

(75) Inventors: Alexandr Tatarinov, Moscow (RU); Viktoria Petrova, Moscow (RU)

(73) Assignee: Oy ECE Eco Cooling Engineering Ltd., Helsinki (FI)

( * ) Notice: Subject to any disclaimer, the term of this patent is extended or adjusted under 35 U.S.C. 154(b) by 924 days.

(21) Appl. No.: 12/351,043

(22) Filed: Jan. 9, 2009

(65) Prior Publication Data

US 2009/0199573 A1 Aug. 13, 2009

Related U.S. Application Data

(60) Provisional application No. 61/006,417, filed on Jan. 11, 2008.

(51) Int. Cl.
*F25B 9/04* (2006.01)

(52) U.S. Cl.
CPC ..... *F25B 9/04* (2013.01)

(58) Field of Classification Search
CPC ..... F25B 9/04; F25B 31/00; F25B 41/00; F25B 41/2341; F25B 1/06; F25B 9/08; F25B 21/02; F25B 2321/02
USPC ..... 62/5, 500, 191, 238.2
See application file for complete search history.

(56) References Cited

U.S. PATENT DOCUMENTS

| | | | | |
|---|---|---|---|---|
| 2,806,466 A * | 9/1957 | Thompson | ..... | 126/113 |
| 3,296,807 A * | 1/1967 | Fekete | ..... | 95/34 |
| 5,483,801 A * | 1/1996 | Craze | ..... | 62/5 |

FOREIGN PATENT DOCUMENTS

| | | |
|---|---|---|
| EP | 0 684 433 A1 | 11/1995 |
| GB | 1073406 | 6/1967 |

(Continued)

OTHER PUBLICATIONS

International Search Report, dated Apr. 23, 2009, issued in connection with Counterpart Application No. PCT/FI2009/050015.

(Continued)

*Primary Examiner* — Mohammad M Ali
(74) *Attorney, Agent, or Firm* — Venable LLP; Eric J. Franklin

(57) ABSTRACT

A method and apparatus in connection with a vortex tube process. A pressurized medium flow is fed into a nozzle inlet. The medium flow expands while moving forward. The medium flow is twisted while entering a working tube. The twisted medium flow is divided into separate cold and hot flows. The cold flow is discharged from the vortex tube via a cold flow head after going through a hole in the center of a wall limiting a first end of the working tube. The hot flow is discharged from the vortex tube via a hot flow head after passing through the working tube having a flow valve at its second end. Parameters of thermodynamic processes in the vortex tube are controlled: by regulating the hot flow rate in the hot flow head by regulating the medium flow in the nozzle inlet, by regulating an efflux speed of the cold and/or hot flows in the vortex tube, and/or by intensification of heat transfer in the vortex tube by mechanical, chemical and/or electrical assemblies therein. To enable a wide range adjustment of parameters of the conditions for a gaseous flow of a medium, the medium flow may be affected at least by: precooling and/or preionization in connection with the nozzle inlet; extra moisturization in the working tube; and/or mechanical vibration in the working tube before the hot flow head valve.

16 Claims, 6 Drawing Sheets

(56) References Cited

FOREIGN PATENT DOCUMENTS

| | | | |
|---|---|---|---|
| RU | 2045381 | | 10/1995 |
| SU | 1758365 | A1 * | 8/1992 |
| WO | WO 94/19653 | A1 | 9/1994 |
| WO | WO 96/17212 | A1 | 6/1996 |
| WO | WO 9617212 | A1 * | 6/1996 |

OTHER PUBLICATIONS

Written Opinion of the International Searching Authority, dated Apr. 23, 2009, issued in connection with Counterpart Application No. PCT/FI2009/050015.

* cited by examiner

METHOD AND APPARATUS IN CONNECTION WITH A VORTEX TUBE PROCESS

CROSS-REFERENCE TO RELATED APPLICATIONS

This application claims priority to U.S. provisional patent application 61/006,417 filed 11 Jan. 2008.

FIELD OF THE INVENTION

The present invention relates to a method an apparatus in connection with a vortex tube process.

BACKGROUND OF THE INVENTION

The development of environmentally friendly or environmentally benign production processes and technologies posses a key problem today. Therefore, it is of current interest to create methods and devices for obtaining environmentally friendly industrial Aworking fluids and media@ useful to man.

For instance, water and oil-based fluids, called lubricant-coolants, are commonly used in the metal-working industry to cool metals being worked, and fluorine—and cholorine—bearing agents, called freons, are used in the refrigeration industry, to state and conserve products. Both agents are harmful by their impact on man and the environment.

One possible solution for this problem is to use environmentally friendly fluids or media, which are obtained with the aid of vortex tubes using a so called Rank-effect.

Known in the art is a method of controlling thermodynamic processes in a vortex tube using the Rank effect (A. V. Martynov and V. M. Brodyansk AWhat is a Vortex tube, Energy Publishers, 1976, pp. 6-11), according to which a flow of pressurized fluid is fed to a nozzle inlet. In the nozzle inlet the fluid flow is expanded, twisted and delivered to a working tube, wherein the fluid flow is split into cold and hot flows. The cold flow is withdrawn from the first end of the working tube via a cold flow head, and the hot flow is led out of the working tube via a valve placed at the second end of the working tube into a hot flow head. Changing the position of the valve in the beginning of the hot flow head and the nozzle inlet pressure, the parameters of thermodynamic processes in the vortex tube are regulated, which in most cases are the hot and cold flow temperatures, flow rate and the flow efflux speed.

The vortex tube operates as follows: a pressurized medium flow is fed through an admission port into the nozzle inlet. The compressed medium is expanded and split into cold and hot flows, first in the nozzle inlet and then in the working tube. The cold medium flow is carried off through a diaphragm aperture into a cold flow head. Changing the position of the hot flow valve one can vary the rate and temperatures of the cold and hot flows. In order to lower the temperature of the cold flow it is necessary to reduce the cold flow rate by using the valve so as to provide a larger flow section at the hot end of the working tube. Conversely, in order to increase the temperature of the hot flow the valve is used to close down the working tube cross section, thereby reducing the flow section.

Cold and hot flows are formed only if the energy of an incoming flow in the vortex tube is distributed so that certain amount thereof is taken from the cold flow and added to the hot flow. Energy redistribution is, however, a result of a complex thermodynamic processes occurring in the vortex tube. Due to their unique properties, vortex tubes are extensively used in various industries, agriculture and medicine. However, each design of the vortex tube provides for a limited possibility of altering the parameters of cold and hot flows and in order to obtain different parameters of the flows, with traditional implementations one has to modify the design of the vortex tube separately for each and every implementation, which in turn restricts the possibilities of its exploitation.

In EP application 0 684 433 is presented a process, as shown in FIG. 1, for controlling thermodynamic processes in a vortex tube, a vortex tube for carrying out the said process and the use thereof, according to which a process is proposed for controlling thermodynamic processes in a vortex tube by directing a stream of fluid under pressure into a nozzle inlet. In order to obtain the desired characteristics in the cold and hot steams without altering the construction of the tube, the fluid stream in the nozzle inlet is controlled by altering the parameters of state of the thermodynamic processes taking place in the vortex tube. Controlling of the stream in the nozzle inlet is effected by altering the path length of the stream, by splitting the stream into two rotating streams with their own respective path lengths, or by adjusting the speed, flow-rate and pressure of the stream at the entrance to the nozzle inlet. Controlling the stream in the vortex tube is effected by means of the helix mounted in the cavity of the nozzle inlet in such a way that its position in relation to the inlet stream can be altered, and a baffle situated at the entrance to the inlet aperture. The invention can be used for example in machine industry as well as refrigeration and medicine industry etc.

On the other hand as presented in Russian patent number 204 5381, cooling of an apparatus for machining metal can be carried out by a vortex tube, being provided with pneumatic couplings together with cold and hot flow heads and an ionizator with electrodes connected to a power source, whereby the positive electrode is a ring electrode and the negative electrode a needle electrode. Both electrodes are placed in a way that the sharp tips thereof are placed parallel with the cold and hot flow heads. In this case, the cooling unit of the machining apparatus must be provided with an ejector, which is placed by the output end of the cold flow head in a way that the axial placement of the ejector can be adjusted in relation with the output opening of cold flow head and so that it can be connected to a source of desired fluidized medium.

The cooling of a cutting point in the metal machining apparatus operates as follow: air is fed from a source of pressurized air to the nozzle inlet of the vortex tube, in which the air is divided into cold and hot flows. The hot flow gets discharged into the hot flow head through a throttling valve, being placed at the second end of the working tube. The temperature of the cold flow is being regulated in this case traditionally by increasing or decreasing the cross section of the throttling valve. The cold flow is being fed to the cold flow head, having a negative needle electrode therein, in which a high voltage is directed thereto from a current source. The voltage effects a corona arc between the electrodes. In the electric field of the arc occurs ionization of the cold flow, whereby the cold flow is being led as a directed jet to the cutting area of the machining apparatus through an opening in the positive electrode.

On the other hand, a strong jet of ionized air gets inside a cavity inside the ejector causing a vacuum therein. By result thereof, liquid gets collected in the ejector from a liquid source by an elastic piping, the liquid getting sprayed to the ionized cold flow. This high voltage mixture of air and dispersion, comprising ions of oxygen, nitrogen and derivatives thereof, is being fed to the cutting area of the machining apparatus. The mixture cools the point of metal to be cut and moisturizes the graphite dust, being generated during cutting of cast iron, thanks to which dust may not get sprayed in the air of the working environment.

By merely certain structures of a vortex tube, being used particularly for cooling of a cutting area of a machining apparatus, one has, however, limited possibilities to influence on the conditional parameters of the cold and hot flows, whereby in order to achieve adequate alterations of the parameters, it is traditionally necessary to modify the structures of the vortex tube, which for its part limits excessively the possibilities for exploitation of a vortex tube for cooling of a cutting area of a machining apparatus. In addition to the above, humidity of air to be fed inside the vortex tube must be within certain limits (whereby usually drying of the feeding air is required). Limitations for the humidity of the processed air are due to expanding of air in the vortex tube. The reason for this is that in case the air to be fed in the vortex tube is too humid, the operational efficiency of the tube decreases significantly. When excessively humid air is fed to the cold flow head, dying of the corona arc is caused or in other words ionization of the cold flow to be directed to the cutting area of the machining apparatus does not take place. Due to the above, the cooling air flow comprises cutting fluid, but not in ionized state, which is why cooling of the cutting area is not efficient enough and correspondingly oxidated films get generated on the surfaces being processed, in addition to which an excessive amount of heat is spread to the environment.

So, despite the above solutions according to EP 0 684 433 and RU 2045381 and even recent research and development for vortex tubes, there has been found a further need for development of a vortex tube process in order to stabilize the process, without a need for structural modifications of the vortex tube for differing implementations and needs.

SUMMARY OF THE INVENTION

So, it is an aim of embodiments of the invention to achieve a decisive improvement in the problems described above and thus to raise essentially the level of prior art. In order to carry out this aim, embodiments of the invention provide a method and apparatus in connection with a vortex tube process.

As the most important advantages of exemplary embodiments of the method and apparatus in connection with a vortex tube process according to embodiments of the invention may be mentioned simplicity and efficiency of the constructions enabled by the same as well as of its use, whereby environmental harms and energy consumption can be significantly decreased. Thanks to embodiments of the invention, the vortex tube process may be stabilized in a way enabling exploitation of the vortex tube in cooling of machining devices thanks to efficient preprocessing of the pressurized air as well as manipulation of the medium flow in the vortex tube making possible as efficient as possible heat transfer in the working tube etc.

Furthermore by processing of the medium flow prior to the inlet nozzle and inside the inlet nozzle may bring about a very wide possibility for adjustments at the output of the vortex tube, without a need for structural modifications of the vortex tube. This is why this characteristic can be controlled or adjusted also, in case the volume or pressure of the flowing medium changes in its purpose of use.

Particularly, extra moisturization of air in the hot flow head, precooling and/or preionization of air before the inlet nozzle and while feeding air to the cutting area as well as simultaneous vibration by the end of the hot flow head, may make sure increasing of the capacity of the machining process, improved durability of the machining instrument and furthermore better and cleaner operation environment for the workers.

BRIEF DESCRIPTION OF THE DRAWINGS

In the following description, illustrative embodiments of the invention are described in detail with reference to the appended drawings, in which in FIG. 1
is shown a longitudinal cross section of a vortex tube according to prior art, in FIG. 2
is shown a partially cut side view of an advantageous vortex tube exploiting the method and apparatus according to the present invention, in FIGS. 3*a*-3*c*
are shown three advantageous alternative structural implementations by the admission port of the nozzle inlet, in FIGS. 4*a* and 4*b*
is shown as a longitudinal and as a perpendicular cross section an advantageous embodiment of the invention regarding vibration of the hot flow, in FIG. 5
is shown as a longitudinal cross section an advantageous structural implementation of the invention in connection with the output of the cold flow head and in FIG. 6
is shown as a partially cut longitudinal cross section an advantageous embodiment of the invention regarding a thermodynamic process inside the working tube.

DETAILED DESCRIPTION OF EMBODIMENTS OF THE INVENTION

Figure 2:
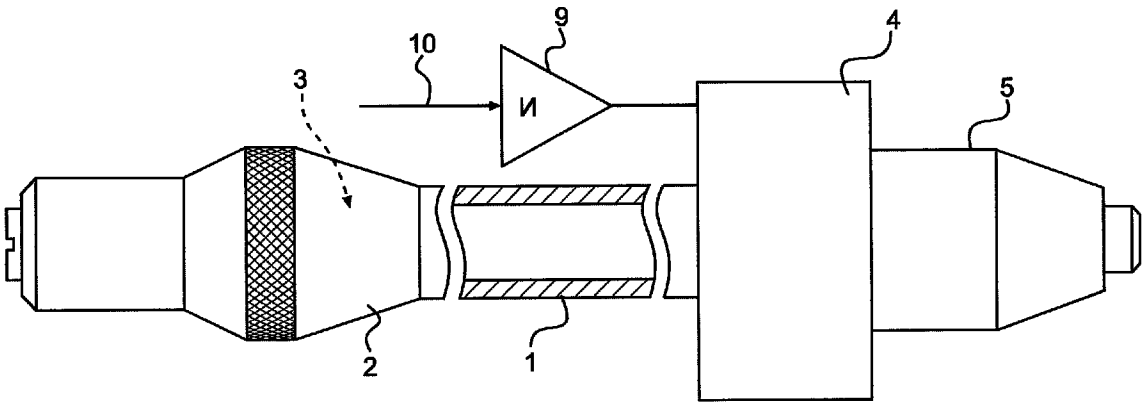
Figure 4A:
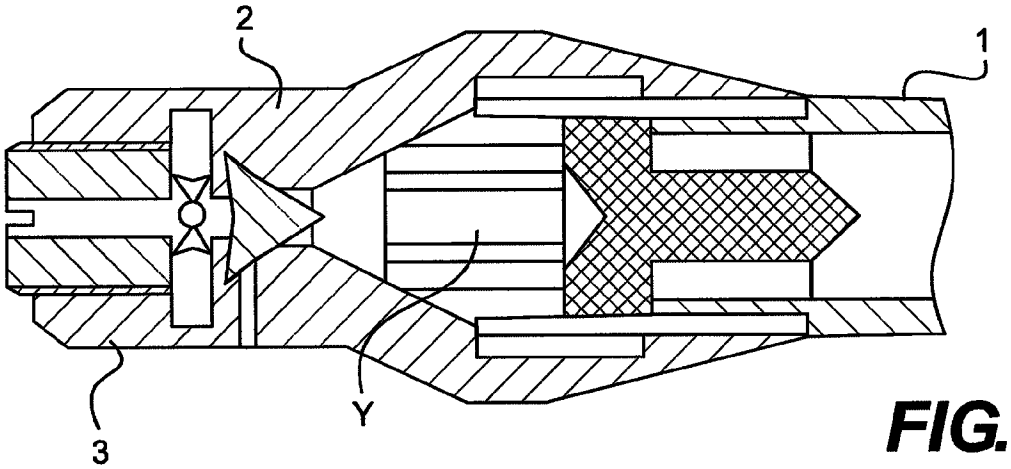
Figure 4B:
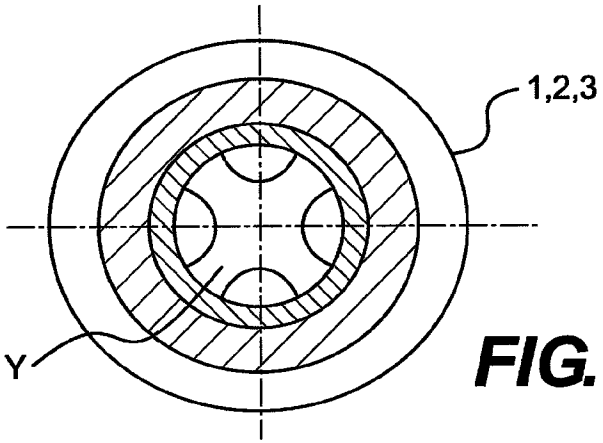
Figure 6:
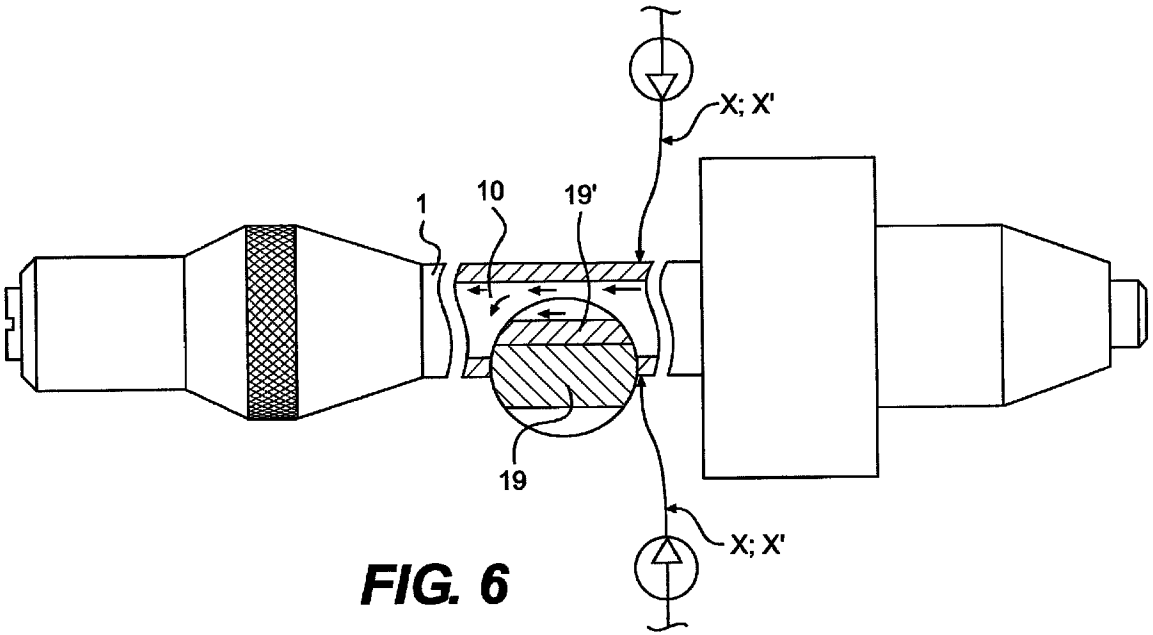

Embodiments of the invention relate to a method in connection with a vortex tube process, wherein; a pressurized medium flow 10 may be fed into a nozzle inlet 4, whereby the medium flow may expand while moving forward; wherein the medium flow may be twisted while entering a working tube 1, whereby the twisted medium flow may be divided into separate cold and hot flows; whereafter the cold flow may be discharged from the vortex tube via a cold flow head 5 after going through a hole 16 in the center of a wall limiting a first end of the working tube 1 and respectively the hot flow may be discharged from the vortex tube via a hot flow head 2 after passing through the working tube 1 having a flow valve 3 at its second end; and wherein parameters of thermodynamic processes in the vortex tube may be controlled: by regulating the hot flow rate in the hot flow head 2 by adjusting the flow valve 3, by regulating the medium flow in the nozzle inlet 4; by regulating an efflux speed, a flow rate and/or a direction of the medium flow in an admission port of the nozzle inlet 4; by amending the path length of the medium flow; by dividing the medium flow into cold and hot flows by differing path lengths, by regulating an efflux speed of the cold and/or hot flows in the vortex tube, and/or by intensification of heat transfer in the vortex tube by mechanical, chemical and/or electrical assemblies therein; by structural or developed surface structures or coatings therein; and/or by ionization of the hot and/or cold flows. Particularly in order to enable a wide range adjustment of parameters of the conditions for a gaseous flow of a medium, such as pressurized air, embodiments of the method may include affecting of the medium flow at least by: precooling and/or preionization 9 in connection with the nozzle inlet 4 as shown in FIG. 2; extra moisturization x; x=in the working tube 1 as shown in FIG. 6; and/or mechanical vibration in the working tube 1 before the hot flow head valve 3 as shown in FIGS. 4*a* and 4*b*.

Depending on the desired characteristics of the hot and/or cold flows, the medium flow taking place in the vortex tube may be controlled by changing conditional parameters of the thermodynamic processes taking place before the nozzle inlet 4, inside the nozzle inlet 4, in the working tube 1, in the cold and hot flow heads 5, 2 and within the medium itself.

The controlling of the thermodynamic processes may be carried out advantageously as follows: before the nozzle inlet 4 by precooling and/or preionizating 9 the medium flow 10; inside the nozzle inlet 4 by altering the flow rate of the medium flow; in the working tube 1 by moisturizing x the same by bringing small dispersioned fluid x into outer periphery of the hot flow, by increasing the convective internal surfaces and/or coatings 1*a* thereof, and/or by vibrating y the hot flow; in the cold flow head 5 by ionizing the cold flow and/or by increasing the efflux speed thereof; and/or respectively in the hot flow head 2 by ionizing the hot flow. Implementations listed above, such as altering of the flow rate inside the nozzle inlet, ionizing of the cold and hot flows and changing of the conditional parameters within the medium itself, have been represented for some parts in greater detail in the EP application 0 684 433 explained in the beginning, this earlier invention being invented by the same inventors as the present invention.

As a further advantageous embodiment, the method according to the invention may be applied in connection with a vortex tube containing a working tube 1, a first end of which may communicate via a control valve 3 with a hot flow head 2 and via a second end with a nozzle inlet 4, the working tube being coaxially disposed thereto and being connected to the cold flow head 5 and via the admission port to the source of medium being fed under pressure to the nozzle inlet 4. In order to control the flow rate within the admission port of the nozzle inlet 4, the medium flow may be preprocessed at least by a precooler and/or ionizator 9. Furthermore the efflux speed of the medium flow by the nozzle inlet 4 may be adjusted advantageously by a speed alteration device. Different kind of implementations for a speed alteration device have been represented in EP application 0 684 433.

As an advantageous embodiment of the method, as shown as a principle in FIG. 6, for moisturizing of the hot flow into outer periphery thereof in the working tube 1, may be brought small dispersioned fluid x, which together with the internal wall 1*a* of the working tube 1, may include a capillary porous surface structure or coating 1*a*, may make possible maximum transfer of heat from the input end to the output end of the working tube 1 by a minimum internal surface area of the working tube 1.

When the hot flow is vibrated by a vibrator which may act advantageously on an independent initiative on grounds of the flow frequency, the temperature separating effect may be made more efficient thanks to the heat exchange getting increased between the flowing medium and the walls of the working tube, by virtue of the heated flow getting discharged from the working tube 1 by pulses.

Embodiments of the invention also relates to an apparatus in connection with a vortex tube process. Embodiments of the vortex tube may include a nozzle inlet 4 for a pressurized medium flow 10 to be processed. The medium flow may get expanded while moving forward and twisted before leaving the nozzle inlet, a working tube 1. While entering the working tube the twisted medium flow may be divided into separate cold and hot flows, a cold flow head 5; in which the cold flow may be led through a hole 16 in the center of a wall limiting a first end of the working tube 1 and from which it may finally be exhausted from the vortex tube, and a hot flow head 2; in which the hot flow may be led from the working tube 1 through a flow valve 3 at its second end and from which it may finally be exhausted from the vortex tube. According to exemplary embodiments, parameters of thermodynamic processes in the vortex tube may be controlled: by regulating the hot flow rate in the hot flow head 2 by adjusting the flow valve 3, by regulating the medium flow in the nozzle inlet 4; by regulating an efflux speed, a flow rate and/or a direction of the medium flow by an admission port thereof; by amending the path length of the medium flow; by dividing the medium flow into cold and hot flows by differing path lengths, by regulating an efflux speed of the cold and/or hot flows at an outlet of the vortex tube, by intensification of heat transfer in the vortex tube by mechanical, chemical and/or electrical assemblies therein; by structural or developed surface structures or coatings therein; and/or by ionization of the hot and/or cold flows. Particularly in order to enable a wide range adjustment of parameters of the conditions for a flow of gaseous medium, such as pressurized air in the vortex tube, embodiments of the apparatus may include at least auxiliary precooling and/or preionizing means 9 for ionization of the medium flow in connection with the nozzle inlet 4 as shown in FIG. 2; a moisturizing means x for affecting of the hot flow by extra moisturization in the working tube 1 as shown in FIG. 6 and/or vibrating means y for mechanical vibration of the hot flow in the working tube 1 before the hot flow head valve 3 as shown in FIGS. 4*a* and 4*b*.

As an advantageous embodiment with reference to FIG. 6, the moisturizing means x may be carried out by bringing small dispersioned fluid x into outer periphery of the hot flow in the working tube 1.

As a further advantageous embodiment with reference to FIG. 6, the working tube 1 may include a capillary porous surface structure or coating 1*a* on its internal wall 1*a* and/or a vibration means y as shown in FIGS. 4*a* and 4*b* in order to vibrate the hot flow.

Figure 3B:
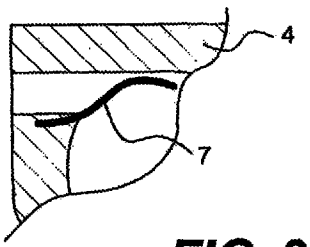
Figure 3C:
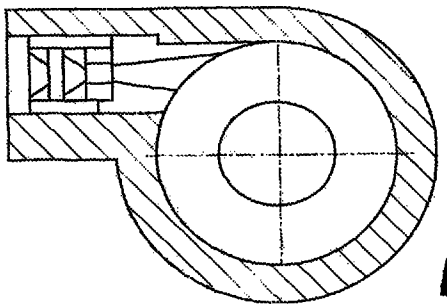
Figure 3A:
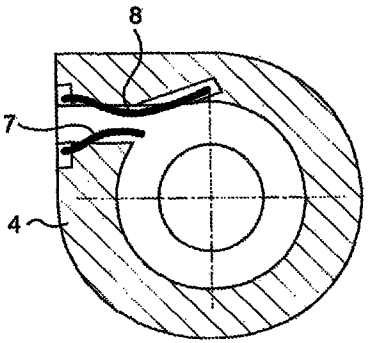
Figure 5:
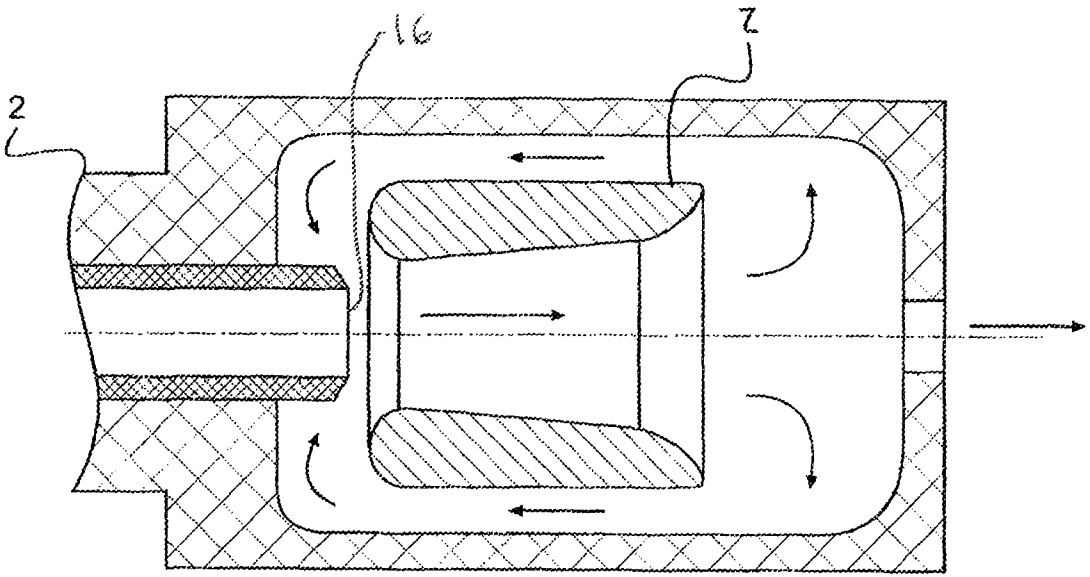

As shown in FIGS. 3*a* and 3*b* the admission port of the nozzle inlet 4 may be made of at least one flexible plate 7, 8. As a further advantageous embodiment particularly with reference to FIG. 5 the output of the cold flow head 2 may include a return flow vortex ejector z. As to the embodiment shown in the FIG. 3*c*, the admission port of the inlet nozzle 15 may be carried out by a laval-nozzle, which may be provided with the possibility to axial displacement, in order to enable adjustment in case the pressure of the flow medium gets increased.

Figure 1:
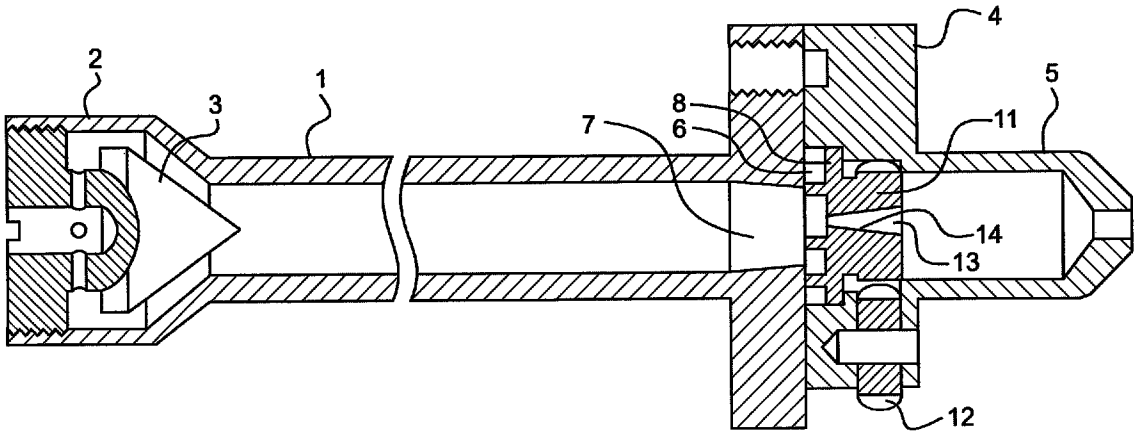
FIG. 1 Prior Art

With reference to the prior art, FIG. 1 illustrates one possible variant of the nozzle inlet 4, comprising a cylindrical sleeve 7 disposed coaxially in line with the working tube 1 and matching therewith.

The other end the cylindrical sleeve 7 may be limited by a diaphragm 8 with a central aperture 14. A flat spiral embracing the aperture 9 may be rigidly secured by one of its end edge at the end surface of the diaphragm 8 facing the nozzle inlet 4, and a gear wheel 11 engaging another gear wheel 12 with marks and digits to rotate the diaphragm 8 around its own axis, may be rigidly secured coaxially with the diaphragm 8 at the other end surface of the latter. In so doing the gear wheel 11 may have a conic opening 13, which together with a central aperture 14 in the diaphragm 8 forms a duct to withdraw a cooling flow to the cold flow head 5.

As the diaphragm 8 rotates the spiral 10 may occupy different positions relative to the admission port 6 of the nozzle inlet 4. This is, however, only one exemplary implementation of the invention according to EP 0 684 433.

Generally taken there are hundreds of articles, trying to explain theoretically vortex-effect, but none of them take into account all factors that are characteristic for 3D-flows inside the vortex tube. Traditional hypotheses result from different assumptions about the energy exchange mechanism in the vortex tube. These hypotheses are forced to use simplifications, correctness of which is difficult to judge. In scientific reviews all these hypotheses are combined in ten groups. In a vortex tube according to embodiments of the present invention typically only one hypothesis has been applied, the correctness of which is supported by the experimental data reached so far. This hypothesis is the "hypothesis of vortices interaction", where energy separation process is the result of two vortices interaction, whereby the vortices are travelling alongside the axis against each other: peripheral, rotated according to potential vortex law and by axial, rotating according to quasi-solid body's law.

In a vortex-tube of the present invention, the "hypothesis of vortices interaction" works as following: there are elementary cooled gas cycles on microscopical level, as a result of the radial travel of micro volumes of gas: micro volumes of gas are adiabatically compressed, while moving up the radius; hot micro volume transfer heat to the surrounding vortical layers, while being on the upper radial position; micro volumes of gas are adiabatically expanded, while moving down the radius, and at the same time performing work on the surrounding vortical layers; micro volumes of gas absorbing heat from the surrounding vortical layers, while being on the lower position.

Therefore, designs inside the vortex tube according to embodiment of the invention typically are focused on the possibility to control micro volumes of gas in different sections of the tube. Other solutions, such as change of the air mixture itself—humidity, temperature, pre-ionization, etc., are focused on practical purposes of the embodiments of invention—to have the air-dispersed mixture at the tube's output, which has bigger by volume percent of charged atoms and molecules, refrigerated down to the lower temperatures and etc. The above is needed particularly for the machining implementation.

Goals of embodiments of the present invention may include:—influence (control) on the thermodynamic processes inside the tube, as well as on the incoming air, before the vortical tube, inside the tube and at the output sections (at the cold and hot ends). Any change to the air mixture (contents of the mixture, condition of the mixture—pre-ionization, pre-cooling, adding other gases, etc.) of the input nozzle, design of the hot and cold nozzle necks (ends), absolutely, influence on the thermodynamic processes inside the vortical tube.

It is clear that the invention is not limited to the embodiments described above, but instead it can be modified within the needs and implementations for differing purposes at any given time. So, generally taken a hot fluid flow in the vortex tube can be used to heat premises and an ionized hot flow can be used for very many kinds of purposes in addition to what has been mentioned before, e.g. to provide premises with ionized air, and in agriculture, by supplying ionized hot air to greenhouses and nurseries.

Thus, due to a broad spectrum of the obtained parameters of hot and cold flows the disclosed designs of the vortex tube make it possible to use one and the same design of the vortex tube for various purposes and in different fields, thereby facilitating the provision of environmentally benign of friendly production processes. So, the design of the vortex tube of the invention can be used very widely in the manufacturing and freezing industries, as well as in the field of medicine and agriculture etc.

We claim:

1. A method in connection with a vortex tube process, the method comprising:

feeding a pressurized medium flow into a nozzle inlet, the medium flow expanding while moving forward, wherein the medium flow is twisted while entering a working tube;

dividing the twisted medium flow into separate cold and hot flows;

discharging the cold flow from the vortex tube via a cold flow head after going through a hole in a center of a wall limiting a first end of the working tube;

discharging the hot flow from the vortex tube via a hot flow head after passing through the working tube having a flow valve at its second end;

controlling parameters of thermodynamic processes in the vortex tube at least by preionization of the medium flow prior to flow into the vortex tube; and enabling adjustment of parameters of the conditions for a gaseous flow of a medium, by affecting the medium flow at least by one of precooling or the preionization prior to flow into the nozzle inlet.

2. The method according to claim 1, wherein the medium flow taking place in the vortex tube is controlled by changing conditional parameters of the thermodynamic processes taking place before the nozzle inlet, inside the nozzle inlet, in the working tube, in the cold and hot flow heads and within the medium itself.

3. The method according to claim 2, wherein the controlling of the thermodynamic processes is carried out:

before the nozzle inlet by precooling and/or preionizating the medium flow;

inside the nozzle inlet by altering the flow rate of the medium flow;

in the working tube by moisturizing the working tube by bringing small dispersioned fluid into outer periphery of the hot flow by increasing the convective internal surfaces thereof, and/or by vibrating the hot flow; in the cold flow head by ionizing the cold flow and/or by increasing the efflux speed thereof; and respectively in the hot flow head by ionizing the hot flow.

4. The method according to claim 1, wherein the method is applied in connection with a vortex tube containing a working tube, a first end of which communicates via a control valve with a hot flow head and via a second end with a nozzle inlet, the working tube being coaxially disposed to the vortex tube and being connected to the cold flow head and via the admission port to the source of medium, being fed under pressure to the nozzle inlet, wherein in order to control the flow rate within the admission port of the nozzle inlet, the medium flow is preprocessed at least by a precooler and/or a preionizator and whereby the efflux speed of the medium flow by the nozzle inlet is adjusted by a speed alteration device.

5. The method according to claim 1, wherein extra moisturization in the working tube is utilized in order to enable a wide range adjustment of parameters of the conditions for a gaseous flow of a medium, affecting of the medium flow, and wherein for moisturizing of the hot flow, into outer periphery thereof in the working tube, is being brought small dispersioned fluid, which together with the internal wall of the working tube, comprising a capillary porous surface structure or coating, makes possible maximum transfer of heat from the input end to the output end of the working tube by a minimum internal surface area of the working tube.

6. The method according to claim 1, wherein the medium in the gaseous flow is pressurized air.

7. The method according to claim 1, wherein the parameters of thermodynamic processes in the vortex tube may also be controlled by at least one of regulating the hot flow rate in the hot flow head by adjusting the flow valve, by regulating the medium flow in the nozzle inlet;

regulating at least one of an efflux speed, a flow rate or a direction of the medium flow in an admission port of the nozzle inlet;

amending the path length of the medium flow;

dividing the medium flow into cold and hot flows by differing path lengths, by at least one of regulating an efflux speed of at least one of the cold or hot flows in the vortex tube, or by intensification of heat transfer in the vortex tube by at least one of mechanical, chemical or electrical assemblies therein;

structural or developed surface structures or coatings therein.

8. The method according to claim 1, wherein enabling a wide range adjustment of parameters of the conditions for a gaseous flow of a medium, is further carried out through extra moisturization in the working tube.

9. An apparatus, comprising:

a vortex tube comprising a nozzle inlet for a pressurized medium flow to be processed;

the medium flow getting expanded while moving forward and twisted before leaving the nozzle inlet;

a working tube;

a cold flow head in which the cold flow is led through a hole in the center of a wall limiting a first end of the working tube and from which the cold flow is finally exhausted from the vortex tube;

a hot flow head in which the hot flow is led from the working tube;

a flow valve at a second end of the hot flow head and from which a hot flow is finally exhausted from the vortex tube;

at least one of an auxiliary precooler or a preionizer for cooling or preionization of the medium flow in connection with the nozzle inlet to enable a wide range adjustment of parameters of the conditions for a flow of gaseous medium prior to flow into the vortex tube;

wherein parameters of thermodynamic processes in the vortex tube are controlled at least by the preionization of the medium flow prior to flow into the nozzle.

10. The apparatus according to claim 9, wherein a moisturizer configured to carry out the moisturizing by bringing small dispersioned fluid into outer periphery of the hot flow in the working tube.

11. The apparatus according to claim 9, wherein the working tube comprises a capillary porous surface structure or coating on an internal wall and/or a vibrator in order to vibrate the hot flow.

12. The apparatus according to claim 9, wherein the admission port of the nozzle inlet comprises at least one flexible plate.

13. The apparatus according to claim 9, wherein the output of the cold flow head comprises a return flow vortex ejector.

14. The apparatus according to claim 9, wherein the flow of gaseous medium comprises pressurized air in the vortex tube.

15. The apparatus according to claim 9, wherein parameters of thermodynamic processes in the vortex tube are also controlled: by at least one of regulating the hot flow rate in the hot flow head by adjusting the flow valve, by regulating the medium flow in the nozzle inlet; by regulating at least one of an efflux speed, a flow rate or a direction of the medium flow by an admission port thereof; by amending the path length of the medium flow; by dividing the medium flow into cold and hot flows by differing path lengths, by regulating an efflux speed of at least one of the cold or hot flows at an outlet of the vortex tube, by intensification of heat transfer in the vortex tube by at least one of mechanical, chemical or electrical assemblies therein; or by structural or developed surface structures or coatings therein.

16. The apparatus according to claim 9, further comprising a moisturizure for affecting of the hot flow by extra moisturization in the working tube.

* * * * *